US007691551B2

(12) United States Patent
Abu-Abed et al.

(10) Patent No.: US 7,691,551 B2
(45) Date of Patent: Apr. 6, 2010

(54) IMAGING MEMBER

(75) Inventors: Mohamed Ismail Abu-Abed, Mississauga (CA); Johann E. Junginger, Toronto (CA); Hany Aziz, Oakville (CA); Greg McGuire, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 331 days.

(21) Appl. No.: 11/768,318

(22) Filed: Jun. 26, 2007

(65) Prior Publication Data

US 2009/0004587 A1 Jan. 1, 2009

(51) Int. Cl.
*G03G 15/04* (2006.01)

(52) U.S. Cl. ..... 430/66; 399/166

(58) Field of Classification Search ..... 430/56, 430/66; 399/166

See application file for complete search history.

(56) References Cited

U.S. PATENT DOCUMENTS

| | | | | |
|---|---|---|---|---|
| 3,121,006 | A | 2/1964 | Middleton et al. | |
| 4,664,995 | A | 5/1987 | Horgan et al. | |
| 5,935,749 | A * | 8/1999 | Kawata et al. | 430/66 |
| 6,280,894 | B1 | 8/2001 | Landa et al. | |
| 6,366,752 | B1 * | 4/2002 | Weber | 399/162 |

FOREIGN PATENT DOCUMENTS

| | | |
|---|---|---|
| JP | 52152229 | 12/1977 |
| JP | 56044689 | 4/1981 |
| JP | 04012366 | 1/1992 |
| JP | 04086671 A | 3/1992 |

OTHER PUBLICATIONS

European Search Report dated Nov. 18, 2008.

* cited by examiner

*Primary Examiner*—John L Goodrow
(74) *Attorney, Agent, or Firm*—Fay Sharpe LLP

(57) ABSTRACT

A layer on the reverse side of an imaging member provides excellent crack resistance to the imaging layer(s) on the front side. The crack-deterring backing layer can be a laminated self-adhesive, such as tape, or a coating. Because the crack-deterring backing layer is on the reverse side, it does not affect the electrical properties of the imaging member. Overcoat layers may be used whose function is limited to improved scratch resistance.

19 Claims, 2 Drawing Sheets

IMAGING MEMBER

BACKGROUND

The present disclosure relates generally to electrophotographic imaging members. More specifically, the present disclosure relates to imaging members having enhanced durability. In particular, the imaging members comprise a crack-deterring backing layer on the side of the substrate opposite that of the imaging layers.

In the art of electrophotography, an imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving substrate such as paper. This imaging process may be repeated many times with reusable photosensitive members.

Imaging members are usually multilayered photoreceptors that comprise a substrate support, an electrically conductive layer, an optional hole-blocking layer, an optional adhesive layer, a charge generating layer, a charge transport layer, and an optional protective or overcoat layer(s). For some multilayered flexible photoreceptor belts, an anti-curl layer is employed on the reverse side of the substrate support, opposite to the side carrying the electrically active layers, to achieve the desired photoreceptor flatness.

Imaging members are generally exposed to repetitive cycling, for example by the rollers of a printing machine. This cycling leads to a gradual deterioration in the mechanical and electrical characteristics of the electrically active (i.e. photoconductive) layers. In particular, repetitive cycling can cause cracks to form in the outermost exposed layer, i.e. the charge transport layer or the overcoat layer. Cracks are problematic because they can manifest themselves as print-out defects which adversely affect copy quality. Charge transport layer cracking thus reduces the service life of the copier or printer.

In addition, the operating environment exposes the imaging member to several conditions, which can decrease its service life. The imaging member is exposed to several airborne chemical contaminants. Typical chemical contaminants include solvent vapors, environment airborne pollutants, and corona species emitted by machine charging subsystems such as ozone. It is also subjected to constant mechanical interactions against various subsystems. These mechanical interactions include abrasive contact with cleaning and/or spot blades, exposure to toner particles, carrier beads, toner image receiving substrates, etc. In particular, these mechanical interactions can scratch the outermost exposed layers. Again, these scratches impact copy quality and service life.

High crack resistance and high scratch resistance are therefore desirable attributes. Overcoat layers help increase both crack resistance and scratch resistance. However, the material properties that are favored to increase one many times undermines the other. For example, a low Young's modulus is desired for increased crack resistance, but a high Young's modulus is desired for increased scratch resistance. The Young's modulus should not exceed 20 GPa and is usually no higher than 5 GPa for flexible imaging members (i.e. belts). The yield strength should no exceed 100 MPa and is usually no higher than 50 MPa. In addition, the overcoat layer should not interfere with the electrical properties of the imaging member. Consequently, the overcoat layer should provide high crack resistance and high scratch resistance, with low interference with the electrical properties of the underlying layers.

Generally, a compromise between these goals is required. Thus, rather than being excellent in all properties, an overcoat is usually excellent in one property and only good in others. It is desired to provide a backing layer that reduces the requirements of an overcoat layer. This would allow the overcoat layer to be tailored to be enhanced in one or more of the desired properties.

BRIEF DESCRIPTION

There are disclosed in various embodiments herein, compositions, which when used on the reverse side of a substrate, provide crack resistance to the imaging layer(s). Because the coating is positioned on the underside of the substrate, the compositions do not interfere with the electrical properties of the imaging member. Thus, the mechanical performance of the outermost exposed layer on the front side of the substrate is separated from the electrical properties of the imaging layers.

Embodiments include an imaging member comprising a substrate, an imaging layer thereon, and a crack-deterring backing layer located on a side of the substrate opposite the imaging layer; wherein the crack-deterring backing layer comprises a backing material selected from the group consisting of vinyl, polyethylene, polyimide, acrylic, paper, canvas, and a silicone material.

Embodiments further include an imaging member comprising a substrate, an imaging layer on a front side of the substrate, and a crack-deterring backing layer located on a reverse side of the substrate; wherein the crack-deterring backing layer comprises a silicone coating.

Embodiments also further include an image forming apparatus for forming images on a recording medium comprising: (a) a photoreceptor member to receive an electrostatic latent image thereon, wherein the photoreceptor member comprises a substrate, an imaging layer on a first side of the substrate, and a crack-deterring backing layer on a second side of the substrate which comprises a backing material selected from the group consisting of vinyl, polyethylene, polyimide, acrylic, paper, canvas, and a silicone material; (b) a development component to develop the electrostatic latent image to form a developed image on the photoreceptor member; (c) a transfer component for transferring the developed image from the photoreceptor member to another member or a copy substrate; and (d) a fusing member to fuse the developed image to the other member or the copy substrate.

BRIEF DESCRIPTION OF THE DRAWINGS

For a better understanding, reference may be had to the accompanying figure.

DETAILED DESCRIPTION

The present disclosure relates to a photoconductive imaging member having a crack-deterring backing layer. In embodiments, the crack-deterring backing layer comprises a backing material selected from the group consisting of vinyl, polyethylene, polyimide, acrylic, paper, canvas, and silicone. In some embodiments, the backing material is silicone. In other embodiments, an adhesive layer is located between the backing layer and the substrate of the imaging member.

Figure 1:
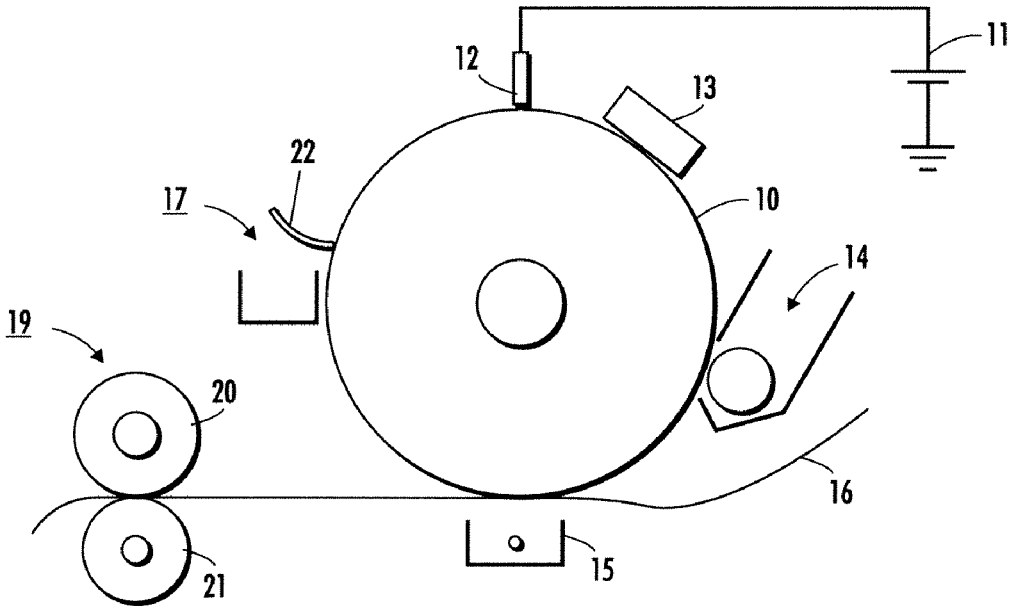
FIG. 1 is an illustration of a general electrostatographic apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from development component 14 into contact therewith. Development can be effected by use of a magnetic brush, powder cloud, or other known development process.

After the toner particles have been deposited on the photoconductive surface, in image configuration, they are transferred to a copy sheet 16 by transfer component 15, which can be pressure transfer or electrostatic transfer. In embodiments, the developed image can be transferred to an intermediate transfer member and subsequently transferred to a copy substrate, such as paper, or transferred directly to a copy substrate.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus. Although the apparatus architecture is shown in FIG. 1 with reference to a photoreceptor drum, the same architecture is used, with suitable modifications, with a flexible imaging member belt.

Figure 2:
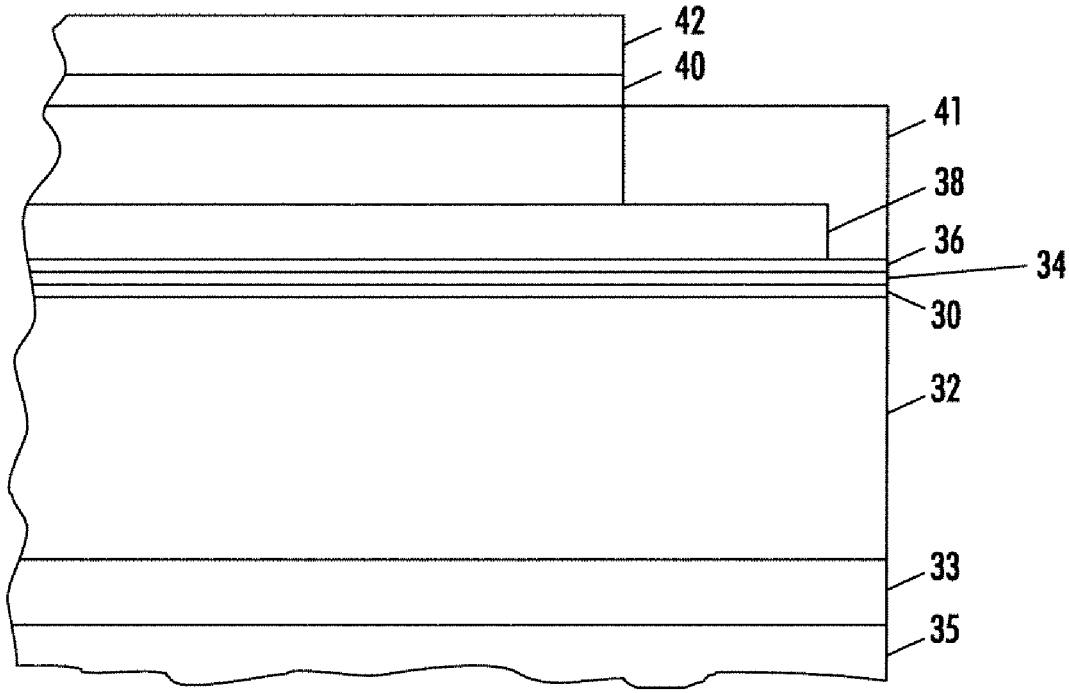
FIG. 2 is a diagram showing the various layers of an imaging member of the present disclosure.

An exemplary embodiment of the imaging member of the present disclosure is illustrated in FIG. 2. The substrate 32 has a conductive layer 30. An optional hole-blocking layer 34 can also be applied, as well as an optional adhesive layer 36. The charge generating layer 38 is located between the optional adhesive layer 36 and the charge transport layer 40. An optional ground strip layer 41 operatively connects the charge generating layer 38 and the charge transport layer 40 to the conductive layer 30. An optional overcoat layer 42 may be placed upon the charge transport layer 40. The crack-deterring backing layer 33 of the present disclosure is located on the reverse side of the substrate 32. An anti-curl back layer 35 may also be applied on the reverse side, which is opposite from the imaging layers. The side on which the imaging layers are located can be considered the front side of the imaging member. The crack-deterring backing layer 33 may be located anywhere on the reverse side relative to the anti-curl back layer 35. In other words, it may be between the anti-curl back layer 35 and the substrate 32 or it may be coated over the anti-curl back layer 35. In specific embodiments, the crack-deterring backing layer is the outermost layer on the reverse side of the substrate 32.

In embodiments, the crack-deterring backing layer comprises a backing material selected from the group consisting of vinyl, polyethylene, polyimide, acrylic, paper, canvas, and a silicone material. Such materials are generally chemically resistant and thus suitable for the photoreceptor environment.

In some embodiments, the crack-deterring backing layer is a silicone material. A polymeric material is dissolved into a solvent to form a coating solution that is applied to the reverse side of the substrate. Generally, any silicon-containing polymer, such as silane and siloxane, can form a suitable crack-deterring backing layer. In embodiments, the silicone material comprises at least one siloxane and at least one silane.

In an embodiment, the silicone material comprises dimethyl methylphenylmethoxy siloxane and methyltrimethoxylsilane. Such dispersions are available as Dow Corning® 1-2620 dispersion or 1-2577 dispersion. According to product specifications available from Dow Corning, the 1-2620 dispersion comprises greater than 60 weight percent dimethyl methylphenylmethoxy siloxane and about 3 to about 7 weight percent methyltrimethoxylsilane in 15-40 weight percent toluene, 10-30 weight percent xylene, and 3-7 weight percent ethylbenzene. The 1-2577 dispersion has the same siloxane and silane amounts, but uses only toluene as the solvent. When dry, the crack-deterring backing layer comprises greater than 90 weight percent of the dimethyl methylphenylmethoxy siloxane and from about 4 to about 10 weight percent of the methyltrimethoxylsilane, based on the dry weight of the crack-deterring backing layer.

In another embodiment, the silicone material comprises dimethyl methylhydrogen siloxane. Such dispersions are available as Dow Corning® Q1-4010 dispersion or 1-4105 dispersion. According to product specifications available from Dow Corning, these dispersions comprise from about 5.0 to about 10.0 and from about 10.0 to about 30.0 weight percent of dimethyl methylhydrogen siloxane (also known as poly(dimethylsiloxane-co-methylhydrosiloxane)), based on the weight of the dispersion, respectively. When dry, the crack-deterring backing layer is about 100 weight percent dimethyl methylhydrogen siloxane.

In another embodiment, the silicone material comprises trimethoxysilyl-terminated dimethyl siloxane, methyltrimethoxysilane, and aminopropyl glycidoxypropyl trimethoxysilane. When dry, the crack-deterring backing layer comprises from about 63 to about 97 weight percent of the trimethoxysilyl-terminated dimethyl siloxane, from about 2 to about 33 weight percent of the methyltrimethoxysilane, and from greater than zero to about 7 weight percent of the aminopropyl glycidoxypropyl trimethoxysilane, based on the dry weight of the crack-deterring backing layer. One dispersion suitable for applying this crack-deterring backing layer is Dow Corning® 3-1753 dispersion. According to product specifications available from Dow Corning, the 3-1753 dispersion comprises greater than 60 weight percent of the trimethoxysilyl-terminated dimethyl siloxane, about 3 to about 7 weight percent of the methyltrimethoxysilane, from about 1 to about 5 weight percent of the aminopropyl glycidoxypropyl trimethoxysilane, and about 1 to about 5 weight percent diisopropoxy di(ethoxyacetoacetyl)titanate, based on the weight of the dispersion. Another suitable dispersion is Dow Corning® 3-1765 dispersion. According to product specifications available from Dow Corning, the 3-1765 dispersion comprises greater than 60 weight percent of the trimethoxysilyl-terminated dimethyl siloxane, about 10 to about 30 weight percent of the methyltrimethoxysilane, about 7 to about 13 weight percent octamethylcyclotetrasiloxane, about 1 to about 5 weight percent decamethylcyclopentasiloxane, about 1 to about 5 weight percent diisopropoxy di(ethoxyacetoacetyl)titanate, less than 1 weight percent aminopropyl glycidoxypropyl trimethoxysilane, less than 1 weight percent vinyltrimethoxysilane, less than 1 weight percent methyl alcohol, and less than 1 weight percent dimethyldimethoxysilane, based on the weight of the dispersion.

In some embodiments, the coating solution used to apply the backing layer may have a viscosity of from about 50 to about 20,000 centipoise, or from about 100 to about 500 centipoise.

In other embodiments, the imaging member may further comprise an adhesive layer located on the reverse side of the substrate between the backing layer and the substrate. The adhesive layer may comprise an adhesive material selected from the group consisting of silicone, rubber, acrylic, and the like.

In embodiments including an adhesive layer, the backing layer and adhesive layer may be applied together as a laminated self-adhesive. For example, commercial tapes normally comprise a backing and an adhesive. Exemplary commercial tapes may be vinyl tape, masking tape, or electrical tape. These types of tape are distinguished by various features. A vinyl tape comprises a vinyl backing and an adhesive. Masking tape comprises a paper backing and an adhesive. The masking tape adhesive generally will not provide adhesion for a long period of time, i.e. the tape should only be applied for temporary periods of less than a month. A common use of masking tape is for protecting surfaces where adjacent surfaces are being painted. The masking tape adhesive is selected so as to be cleanly removed. Electrical tape comprises a vinyl backing and an adhesive. The electrical tape backing may be nonconducting, i.e. insulating, though this property is not required for crack resistance. The backing may also have elastic properties, i.e. have a reversible elastic elongation in the tensile direction. The electrical tape adhesive provides adhesion for long periods of time, on the order of months or years. The electrical tape adhesive is not necessarily cleanly removed. The electrical tape adhesive may also be selected so as to preferentially adhere to the electrical tape backing, i.e. it sticks to the backing, not the surface to which the tape is applied. These types of tape are not mutually exclusive; for example, a tape can be a vinyl tape and an electrical tape.

In embodiments comprising an adhesive layer, the backing material is selected from the group consisting of vinyl, polyethylene, polyimide, acrylic, paper, and canvas; and the adhesive material is selected from the group consisting of silicone, rubber, and acrylic. In a specific embodiment, the laminated self-adhesive is 3M™ Vinyl 471. This conformable self-adhesive tape has a vinyl backing and a rubber adhesive. The vinyl backing may be transparent or pigmented. According to product specifications available from 3M, the transparent Vinyl 471 tape has the following representative properties: a backing thickness of 4.1 mils (0.10 mm); a total thickness of 5.4 mils (0.14 mm); tensile strength of 16 pounds/inch; elongation at break of 180%; and a useful temperature range of 4 to 77° C. It should be noted that 3M offers vinyl tapes of various colors; the color is not significant in the present disclosure. One or more layers of the laminated self-adhesive may be used. In embodiments, two or three layers are used.

The crack-deterring backing layer may have a volume resistivity of from about $2\times10^{13}$ to about $3\times10^{15}$ ohm-centimeters. The volume resistivity is a measure of how well the material opposes the flow of electric current.

The crack-deterring backing layer may also have high wear resistance. High wear resistance in the backing layer increases crack resistance in the imaging layer by preventing the formation of loose particulates that, when impacted between the substrate and the rollers in the imaging machine, produce cracks in the imaging layer(s). In embodiments, the backing layer has a wear rate of from zero to about 30 nanometers per kilocycle, or from zero to about 5 nanometers per kilocycle.

The thickness of the crack-deterring backing layer may vary from about 5 microns to about 200 microns, or from about 10 microns to about 150 microns. The Vinyl 471 laminated self-adhesive has a total thickness of about 14 microns.

If desired, multiple crack-deterring backing layers may be applied to the reverse side of the imaging member. In particular, one or more laminated self-adhesive layers may be applied.

The crack-deterring backing layer may have anti-curl properties. Curl occurs in a photoreceptor because each layer has a different thermal contraction coefficient or due to shrinkage during the drying process. In particular, the charge transport layer 40 usually has a higher contraction coefficient than the substrate 32. In forming the imaging member, the charge transport layer is formed from a solution which is then heated or otherwise dried. As a result of the mismatch, the higher contraction coefficient causes the imaging member to curl as the imaging member cools from the higher drying temperature down to ambient temperature. The anti-curl back layer 35 is applied to flatten the substrate.

Because the crack-deterring backing layer increases crack resistance in the imaging layers (i.e. the charge generating and charge transport layers), the outermost exposed layer on the front side of the imaging member does not need to provide crack resistance. Thus, the composition of the charge transport layer or the overcoat layer can be optimized to increase scratch resistance. For example, an overcoat layer formed from a composition of acrylic polyol binder, melamine-formaldehyde curing agent, and di-hydroxy biphenyl amine has excellent scratch resistance, but lacks in crack resistance. Such an overcoat layer, disclosed in U.S. patent application Ser. No. 11/275,546, filed Jan. 13, 2006, by Yu Qi, et al., could be used in conjunction with the crack-deterring backing layer of the present disclosure. Such overcoat layers may also consist of only (i) a hydroxyl containing polymer (polyesters and acrylic polyols); (ii) a melamine-formaldehyde curing agent; and (iii) a hole transport material. The presence of a co-binder in the overcoat layer is associated with improved crack resistance, but poorer electrical performance. A co-binder may not be required in an imaging member comprising the crack-deterring backing layer of the present disclosure.

The substrate 32 may be opaque or substantially transparent and may comprise any suitable material having the required mechanical properties. Accordingly, the substrate may comprise a layer of an electrically non-conductive or conductive material such as an inorganic or an organic composition. Various resins may be employed as non-conductive materials including polyesters, polycarbonates, polyamides, polyurethanes, and the like, which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a sheet and the like.

The thickness of the substrate depends on numerous factors, including strength and desired and economical considerations. A flexible belt may be of substantial thickness, for example, about 250 micrometers, or of minimum thickness, e.g., less than 50 micrometers, provided there are no adverse effects on the final electrophotographic device.

In embodiments where the substrate is not conductive, the surface thereof may be rendered electrically conductive by an electrically conductive coating 30. The conductive coating may vary in thickness over substantially wide ranges depending upon the optical transparency, degree of flexibility desired, and economic factors. Accordingly, for a flexible photoresponsive imaging device, the thickness of the conductive coating may be from about 20 angstroms to about 750 angstroms, and more preferably from about 100 angstroms to about 200 angstroms for an optimum combination of electrical conductivity, flexibility, and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole-blocking layer 34 may be applied to the substrate. Any suitable and conventional blocking layer capable of forming an electronic barrier to holes between the adjacent photoconductive layer and the underlying conductive surface of a substrate may be used.

An optional adhesive layer 36 may be applied to the hole-blocking layer. Any suitable adhesive layer may be used and such adhesive layer materials are well known in the art. Typical adhesive layer materials include, for example, polyesters, polyurethanes, and the like. Satisfactory results may be achieved with adhesive layer thickness from about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying, and the like.

At least one electrophotographic imaging layer is formed on the adhesive layer, hole-blocking layer, or substrate. The electrophotographic imaging layer may be a single layer that performs both charge generating and charge transport functions, as is well known in the art, or it may comprise multiple layers such as a separate charge generating layer 38 and charge transport layer 40.

Charge generating (also referred to as photogenerating) layers may comprise amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The charge generating layer may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakisazos; and the like dispersed in a film forming polymeric binder and fabricated by solvent coating techniques.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene bisimide pigments; indigo pigments such as indigo, thioindigo, and the like; bisbenzoimidazole pigments such as Indofast Orange toner, and the like; phthalocyanine pigments such as titanyl phthalocyanine, aluminochlorophthalocyanine, hydroxygalliumphthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the disclosure and include for instance selenium-arsenic, selenium-tellurium-arsenic, and selenium-tellurium.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal-free phthalocyanine. The phthalocyanines exist in many crystal forms, which have a strong influence on photo-generation.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrenealkyl resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder. In embodiments, preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing the solvent of a solvent coated layer may be effected by any suitable conventional technique such as oven drying, infrared radiation drying, air drying and the like.

In fabricating a photosensitive imaging member, a charge generating material (CGM) or pigment, herein the terms "pigment" and "charge generating material" are used interchangeably, and a charge transport material (CTM) may be deposited onto the substrate surface either in a laminate type configuration where the CGM and CTM are in different layers or in a single layer configuration where the CGM and CTM are in the same layer along with a binder resin. A photoreceptor can be prepared by applying over the electrically conductive layer the charge generating layer and a charge transport layer. In embodiments, the charge generating layer and the charge transport layer may be applied in any order.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as arylamines; carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(-vinyltetraphene); poly(vinyltetracene) and poly(vinylperylene).

Aryl amines selected as the hole transporting component include molecules of the following formula

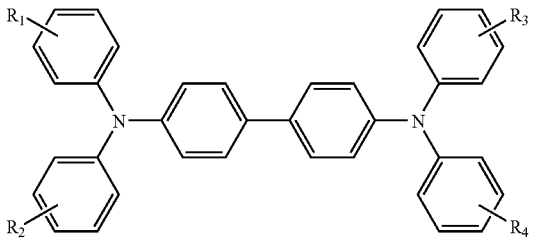

preferably dispersed in a highly insulating and transparent polymer binder, wherein $R_1$, $R_2$, $R_3$, and $R_4$ are independently selected from alkyl and halogen, especially those substituents selected from the group consisting of Cl and $CH_3$.

Examples of specific aryl amines are N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine (TPD) wherein the halo substituent is preferably a chloro substituent; N,N,N',N'-tetra(4-methylphenyl)-(1,1'-biphenyl)-4,4'-diamine; and N,N'-bis(4-butylphenyl)-N,N'-bis(3-methylphenyl)-(1,1'-p-terphenyl)-4,4"-diamine. Other known charge transport layer molecules can be selected, reference for example U.S. Pat. Nos. 4,921,773 and 4,464,450, the disclosures of which are totally incorporated herein by reference.

Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone, biphenylquinones and phenylquinones.

Any suitable inactive resin binder with the desired mechanical properties may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000. However, the resin binder of the charge transport layer should not be soluble in the solvent used to apply the overcoat layer of the present disclosure.

Any suitable technique may be used to apply the charge transport layer and the charge generating layer. Typical application techniques include spraying, dip coating, roll coating, wire wound rod coating, vacuum coating, and the like. Drying of the deposited coating may be effected by any suitable conventional technique such as oven drying, infra-red radiation drying, air drying and the like.

Generally, the thickness of each charge generating layer ranges from about 0.1 micrometer to about 3 micrometers and the thickness of the transport layer is from about 5 micrometers to about 100 micrometers, but thicknesses outside these ranges can also be used. The thickness of the charge generating layer adjacent to the charge transport layer is selected so that the required fraction of the charge is trapped resulting in the desired voltage. The desired thickness is then governed by the fraction of charge transiting the charge generating layer adjacent to the charge transport layer. In general, the ratio of the thickness of the charge transport layer to the charge generating layer is preferably maintained from about 2:1 to 200:1 and in some instances as great as 400:1.

An overcoat layer 42 may be used to give the imaging member surface additional scratch resistance. Overcoat layers are known in the art. Generally, they serve a function of protecting the charge transport layer from mechanical wear and exposure to chemical contaminants. However, of particular importance is the fact that overcoat layers are generally formulated to provide high crack resistance and high scratch resistance. As noted, the crack-deterring backing layer of the present disclosure means the composition of the outermost exposed layer (i.e. the charge transport layer or the overcoat layer) does not need to provide crack resistance, but can be formulated to provide comparatively higher scratch resistance. In particular embodiments, the overcoat layer provides only improved scratch resistance.

The thickness of the overcoat layer may be selected as desired. If the overcoat layer is too thick, the background potential of the imaging member will increase (i.e. the electrical properties are adversely affected). The upper limit of the thickness also depends on the polymer material used to form the overcoat layer and/or the molecular weight of the polymer material. The thickness of the dried overcoat layer may be from about 0.5 to about 10 μm. In other embodiments, the dried overcoat layer has a thickness of from about 1.0 to about 5 μm.

An optional anti-curl back coating 35 can be applied to the reverse side of the substrate support 32 (which is the side opposite the side bearing the photoconductive layers) in order to render flatness. Although the anti-curl back coating may include any electrically insulating or slightly semi-conductive organic film-forming polymer, it is usually the same polymer as used in the charge transport layer polymer binder. An anti-curl back coating from about 7 to about 30 micrometers in thickness is found to be adequately sufficient for balancing the curl and render imaging member flatness.

An electrophotographic imaging member may also include an optional ground strip layer 41. The ground strip layer comprises, for example, conductive particles dispersed in a film forming binder and may be applied to one edge of the photoreceptor to operatively connect the charge transport layer 40, charge generating layer 38, and conductive layer 30 for electrical continuity during electrophotographic imaging process. The ground strip layer may comprise any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

The prepared imaging member may be employed in any suitable and conventional electrophotographic imaging process which uses uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure.

The imaging members of the present disclosure may be used in methods of imaging and printing. These methods comprise generating an electrostatic latent image on the imaging member. The latent image is then developed with a toner composition and transferred to a suitable substrate, such as paper, to which the image is permanently affixed. Processes of imaging, especially xerographic imaging and printing, including digital, are also encompassed by the present disclosure. More specifically, the layered photoconductive imaging members of the present development can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

All the patents and applications referred to herein are hereby specifically, and totally incorporated herein by reference in their entirety in the instant specification.

The following Examples further define and describe embodiments herein. Unless otherwise indicated, all parts and percentages are by weight.

EXAMPLES

Example 1

Laminated Crack-Deterring Backing Layer

Masking tape, canvas tape, and electrical tape were collected and applied to the reverse side of a belt photoreceptor strip to form a crack-deterring backing layer. The control was a strip without an anti-curl layer or a crack-deterring backing layer (this strip was used as the control for all of the Examples). Each strip was run through a tri-roller fixture for 10 kilocycles. Each strip was then print-tested in a standard machine under standard machine operating procedures.

Images of the three strips were taken and digitized using the line-art (mono) setting of a commercial UMAX document scanner at 600 dpi. A rectangular region of interest, ~1 inch× ~2.5 inch, was selected to cover the region of the strip that was stressed in the tri-roller. The black spots in that region were counted by a commercial spot counting software (NI Vision Assistant 7.1); only those spots having an area larger than 1 pixel were counted, as single-pixel spots may result from noise, such as background, charge deficient spots, and other non-crack related defects. The number of black spots corresponded to the number of cracks. The results were normalized, so that the control was given a value of 100. The results are shown in Table 1.

TABLE 1

| Control | Masking Tape | Canvas Tape | Electrical Tape |
|---|---|---|---|
| 100 | 69 | 85 | 18 |

Electrical tape (3M™ Vinyl 471) was seen to give the best crack resistance. It had 5 times fewer cracks compared to the control.

Next, 1, 2, or 3 layers of electrical tape were applied to the reverse side of a standard belt photoreceptor strip. In addition, two photoreceptor strips were prepared, each of which had 1 layer of electrical tape which had been pre-stressed by stretching in the tensile direction. The control was a strip without a crack-deterring backing layer. Each strip was run through a tri-roller fixture, then print-tested and counted as described above. The results are shown in Table 2.

TABLE 2

| Control | 1 Layer | 2 Layers | 3 Layers |
|---|---|---|---|
| 100 | 27 | 37 | 9 |

Pre-stressing the tape had little effect on the crack resistance of the photoreceptor strip.

Example 2

Solution-Coated Crack-Deterring Backing Layer

Dow Corning® 1-2620 conformal polymer dispersion was applied to the reverse side of standard belt photoreceptor strips to form a crack-deterring backing layer. The strips had four different thicknesses: 6 microns, 35 microns, 70 microns, and 150 microns). Each strip was run through a tri-roller fixture, then print-tested and counted as described above. The results are shown in Table 3.

TABLE 3

| Control | 6 μm | 35 μm | 70 μm | 150 μm |
|---|---|---|---|---|
| 100 | 9 | 2 | 1 | 1 |

The prints show that the coating on the reverse side provided excellent crack resistance. Even at 6 μm, there were at least 10 times fewer cracks compared to the control.

Example 3

Anti-Curl Layer and Crack-Deterring Backing Layer

Makrolon® was applied to the reverse side of a photoreceptor strip to form an anti-curl layer 20 μm thick. Dow Corning® 1-2620 conformal polymer dispersion was applied to the reverse side of another photoreceptor strip to form a crack-deterring backing layer 20 μm thick. Each strip was run through a tri-roller fixture, then print-tested and counted as described above. The results are shown in Table 4.

TABLE 4

| Control | 20 μm Makrolon ® | 20 μm D1-2620 |
|---|---|---|
| 100 | 25 | 4 |

The crack-deterring backing layer resulted in one order of magnitude fewer cracks than the anti-curl layer and two orders of magnitude fewer cracks than the control.

Example 4

Comparison of Wear Rates

The amount of wear in the backing layer of the four strips of Example 2 was measured. The wear was not measurable and considered negligible. Four control strips were run through a tri-roller fixture for 10,000 cycles and the amount of wear measured. The control strips had wear ranging from 300 nanometers to 900 nanometers over the 10,000 cycles.

While devices have been described in detail with reference to specific embodiments, it will be appreciated that various modifications and variations will be apparent to the artisan. All such modifications and embodiments as may readily occur to one skilled in the art are intended to be within the scope of the appended claims.

What is claimed is:

1. An imaging member comprising a substrate, an imaging layer thereon, and a crack-deterring backing layer located on a side of the substrate opposite the imaging layer; wherein the crack-deterring backing layer comprises a backing material selected from the group consisting of vinyl, polyethylene, polyimide, acrylic, paper, and a silicone comprising at least one siloxane and at least one silane.

2. The imaging member of claim 1, wherein said backing material is a silicone comprising dimethyl methylphenylmethoxy siloxane and methyltrimethoxylsilane.

3. The imaging member of claim 1, wherein said backing material is a silicone comprising greater than about 90 weight percent dimethyl methylphenylmethoxy siloxane and from about 4 to about 10 weight percent methyltrimethoxylsilane, based on a dry weight of the crack-deterring backing layer.

4. The imaging member of claim 1, wherein said backing material is a silicone and the siloxane comprises dimethyl methylhydrogen siloxane.

5. The imaging member of claim 1, wherein said backing material is a silicone and comprises trimethoxysilyl-terminated dimethyl siloxane, methyltrimethoxysilane, and aminopropyl glycidoxypropyl trimethoxysilane.

6. The imaging member of claim 5, wherein the crack-deterring backing layer comprises from about 63 to about 97 weight percent of trimethoxysilyl-terminated dimethyl siloxane, from about 2 to about 33 weight percent of methyltrimethoxysilane, and from greater than zero to about 7 weight percent of aminopropyl glycidoxypropyl trimethoxysilane, based on a dry weight of the crack-deterring backing layer.

7. The imaging member of claim 1, wherein the backing material is selected from the group consisting of vinyl, polyethylene, polyimide, acrylic, paper, and canvas; and further comprising an adhesive layer located between the substrate and the backing layer, wherein the adhesive layer comprises an adhesive material selected from the group consisting of silicone, rubber, and acrylic.

8. The imaging member of claim 7, wherein the backing layer comprises vinyl and the adhesive layer comprises rubber.

9. The imaging member of claim 1, further comprising an overcoat layer positioned over the imaging layer, the overcoat layer being formed from a composition comprising acrylic polyol binder, melamine-formaldehyde curing agent, and dihydroxy biphenyl amine.

10. The imaging member of claim 1, further comprising an overcoat layer positioned over the imaging layer, the overcoat layer being formed from a composition comprising a hydroxyl containing polymer, a melamine-formaldehyde curing agent, and a hole transport material.

11. The imaging member of claim 1, wherein the backing layer has a thickness of from about 5 microns to about 200 microns.

12. The imaging member of claim 1, wherein the backing layer has a thickness of from about 10 microns to about 150 microns.

13. The imaging member of claim 1, wherein under identical operating conditions, the imaging layer has at least 5 times fewer cracks than an imaging layer of an imaging member without the crack-deterring backing layer.

14. The imaging member of claim 1, wherein under identical operating conditions, the imaging layer has at least 50 times fewer cracks than an imaging layer of an imaging member without the crack-deterring backing layer.

15. The imaging member of claim 1, wherein the imaging layer comprises a hole transport material of the following formula:

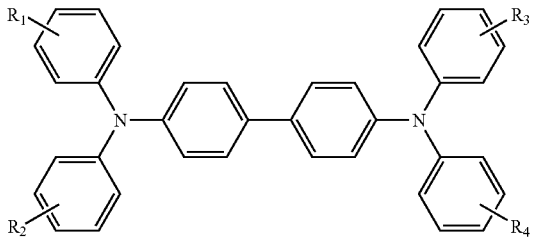

wherein $R_1$, $R_2$, $R_3$, and $R_4$ are independently selected from alkyl and halogen.

16. The imaging member of claim 1, wherein the crack-deterring backing layer has a volume resistivity of from about $2\times10^{13}$ to about $3\times10^{15}$ ohm-centimeters.

17. The imaging member of claim 1, wherein the crack-deterring backing layer has a wear rate of from zero to about 5 nanometers per kilocycle.

18. An imaging member comprising a substrate, an imaging layer on a front side of the substrate, and a crack-deterring backing layer located on a reverse side of the substrate; wherein the crack-deterring backing layer comprises a silicone coating that comprises at least one siloxane and at least one silane.

19. An image forming apparatus for forming images on a recording medium comprising:

a. a photoreceptor member to receive an electrostatic latent image thereon, wherein the photoreceptor member comprises a substrate, an imaging layer on a first side of the substrate, and a crack-deterring backing layer on a second side of the substrate which comprises a backing material selected from the group consisting of vinyl, polyethylene, polyimide, acrylic, paper, and a silicone material that comprises at least one siloxane and at least one silane;

b. a development component to develop the electrostatic latent image to form a developed image on the photoreceptor member;

c. a transfer component for transferring the developed image from the photoreceptor member to another member or a copy substrate; and d. a fusing member to fuse the developed image to the other member or the copy substrate.

* * * * *